US008061803B2

(12) United States Patent
Klug et al.

(10) Patent No.: US 8,061,803 B2
(45) Date of Patent: Nov. 22, 2011

(54) MANUAL INK JET CARTRIDGE CLEANING AND CAPPING STATION

(75) Inventors: Philip D. Klug, Brighton, MI (US); Michael J. Moore, Beverly Hills, MI (US)

(73) Assignee: Burroughs Payment Systems, Inc., Plymouth, MI (US)

( * ) Notice: Subject to any disclaimer, the term of this patent is extended or adjusted under 35 U.S.C. 154(b) by 503 days.

(21) Appl. No.: 12/233,727

(22) Filed: Sep. 19, 2008

(65) Prior Publication Data

US 2010/0073420 A1 Mar. 25, 2010

(51) Int. Cl.
*B41J 2/165* (2006.01)
*B41J 3/36* (2006.01)

(52) U.S. Cl. ..... 347/32; 347/109

(58) Field of Classification Search ..... 347/22, 347/29, 32, 109

See application file for complete search history.

(56) References Cited

U.S. PATENT DOCUMENTS 5,710,634 A * 1/1998 Kuriyama et al. ..... 358/296

* cited by examiner

*Primary Examiner* — An Do

(74) *Attorney, Agent, or Firm* — Honigman Miller Schwartz and Cohn LLP

(57) ABSTRACT

A document processor for capturing data and images from checks and other financial and payment-related documents includes a document track and a plurality of processing devices located along the document track. The plurality of processing devices includes an ink jet rear endorser. A manual ink jet cleaning and capping station is built into the track wall directly in front of the ink jet rear endorser. The station includes a movable track wall portion that is movable between first and second positions and includes an opening and a cap. When the track wall portion is in the first position, the cap engages the endorser to prevent any liquid ink on the endorser from drying. When the track wall portion is in the second position, the opening aligns with the endorser to allow the endorser to print on passing documents.

18 Claims, 5 Drawing Sheets

MANUAL INK JET CARTRIDGE CLEANING AND CAPPING STATION

BACKGROUND OF THE INVENTION

1. Field of the Invention

The invention relates to document processing, to compact, desktop document processors for capturing data and images from checks and other financial and payment-related documents, and to rear endorsement wherein an inkjet cartridge is used to print information on documents.

2. Background Art

Historically, banks processed large volumes of paper checks in centralized locations, either a central bank or a clearing house. Document processing machines in such locations were large, processing up to 2000 documents per minute. These machines were supported by dedicated, trained operators.

However, centralized processing costs banks typically three days in clearing a document. The "Check Clearing for the 21st Century Act" or the "Check 21 Act" was enacted by Congress to facilitate check truncation by authorizing substitute checks, to foster innovation in the check collection system without mandating receipt of checks in electronic form, and to improve the overall efficiency of the Nation's payments system. The Check 21 legislation has driven the demand for decentralized check imagers and sorters in financial institutions. Check 21 gives equal legal validity to electronic data obtained from documents, and has made it possible for banks to distribute document processing to speed the clearing process. Check 21 has made it advantageous for banks to convert paper checks to electronic data as early as possible.

In the recent past, banks have partially converted paper check information to electronic data. In some cases this partial information was used internally. In other cases two banks would agree on standards for electronic data transfer. In either case, the paper check was still the only legal document for the transaction. Check 21 has standardized these agreements across the banking industry, and given the electronic data legal merit, if the electronic data meet the requirements set forth in Check 21.

Since Check 21 theoretically allows the destruction of paper checks after conversion to electronic data, Check 21 requires all data on the paper check to be recorded. As noted, it is advantageous for banks to convert paper checks to Check 21 valid electronic data as early as possible. Accordingly, compact, desktop document processors have been developed. These document processors are capable of obtaining the full suite of data required for Check 21. As well, an existing desktop document processor may perform rear endorsement as a document is processed.

In one example, a non-impact, 600-dpi ink jet rear endorser prints as many as four lines of text or graphic information. The endorser is located in the track before the rear image scanner.

The ink jet cartridge as used in document processing equipment is inserted into a carrier that can be adjusted to one or more heights. Other than that the cartridge does not otherwise move. As documents pass in front of the ink jet cartridge (endorser), information is imprinted on the document. As the inkjet cartridge is used, spurious ink drops collect on the face of the cartridge and must be removed to maintain good print quality. User documentation has described various methods of cleaning such as using a lint free cloth. This involves physically removing covers from the product, removing the cartridge from the carrier and using a cloth (dry or pre-wetted) to clean the cartridge. In lieu of the cloth, a rubber squeegee type tool can be used as well. These methods can be messy for the operator and involve labor and time. The operator might not clean the cartridge as often as necessary to maintain good print quality. The removal of the cartridge itself puts wear and tear on the cartridge carrier and the delicate dimpled flex circuit which provides the electrical interface between the cartridge and control electronics.

For the foregoing reasons, there is a need for a document processor that implements an improved approach for cleaning the ink jet cartridge.

SUMMARY OF THE INVENTION

It is an object of the invention to provide a manual ink jet cleaning and capping station for a document processor.

According to one embodiment of the invention, a solution to the current ink jet cartridge cleaning process is to build ink jet cartridge cleaning capability into the track wall directly in front of the cartridge. This part of the wall will slide up and down between two positions. In one position, the cartridge is "capped," preventing any liquid ink on the nozzle plate of the cartridge from drying. Dry ink is harder to remove than wet. In the other position, the cartridge is "open" and is in a position to print on passing documents. Moving between position one and position two also cleans the face of the cartridge with a squeegee device. In some embodiments, no covers have to be removed and the cartridge can remain within the carrier while it is being cleaned. The operator simply grabs an exposed tab to move the cleaning station up and down. The operator does not come in contact with spent ink. A whole cleaning cycle takes a few seconds, rather than minutes.

Cleaning and capping stations in embodiments of the invention are implemented in document processors employing ink-jet endorsement of financial documents. Even though the cleaning/capping station is intended for table top document processors, it could be used in other document processors from low to medium and high-speed.

In one embodiment, the manual cleaning and capping station rides up and down within a section of track wall via rails, grooves or other similar features. The feature on which the cleaning and capping station rides can be designed to provide a camming effect so that the capping station pivots onto, rather than slides across the ink jet nozzle orifice plate.

DETAILED DESCRIPTION OF THE PREFERRED EMBODIMENTS

Figure 1:
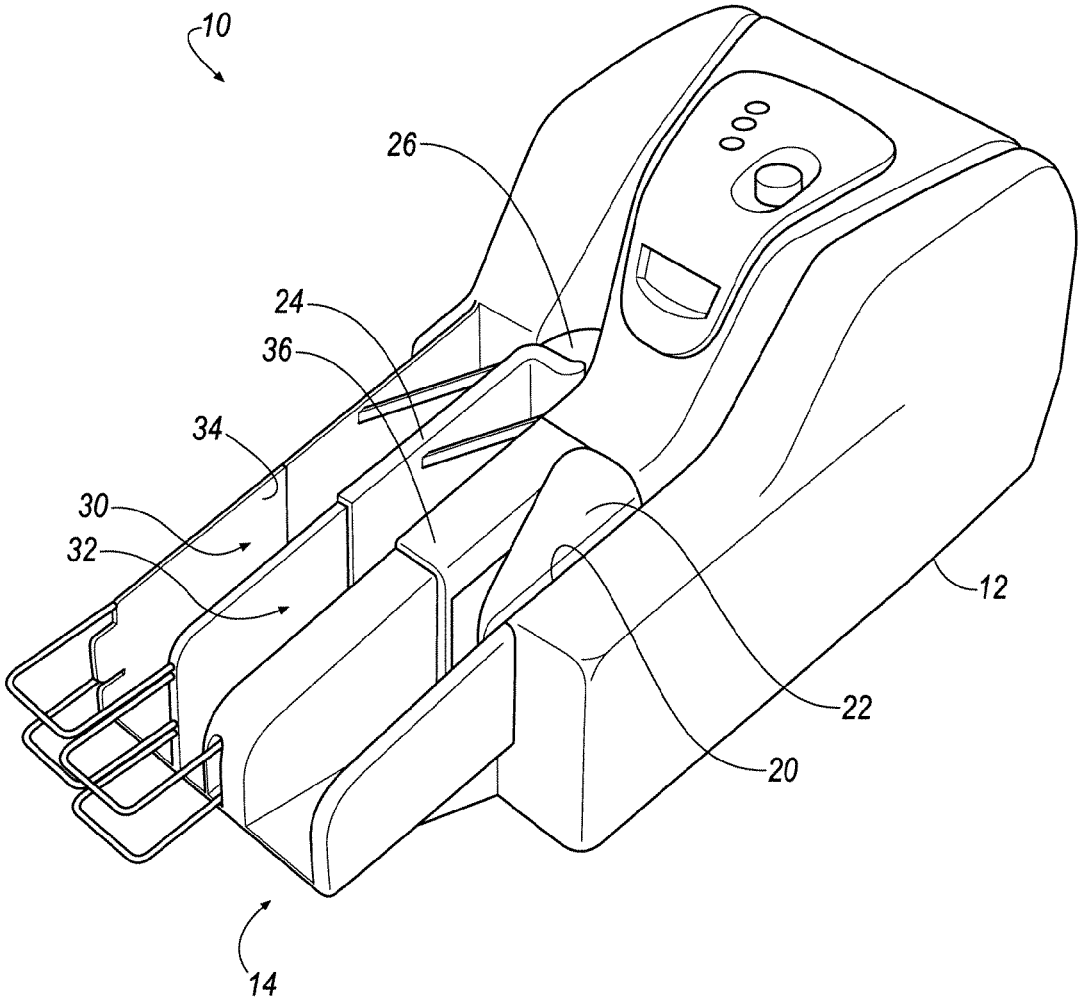
FIG. 1 illustrates a compact, desktop document processor in an embodiment of the invention.

As shown in FIG. 1, a compact, desktop document processor is generally indicated at 10. The apparatus 10 includes base unit 12, and input hopper 14 for receiving a batch of checks to be processed. In general, apparatus 10 is used for decentralized document processing applications. The input hopper 14 provides the operator with an area to place a stack of documents to be processed, supports longer documents, and assists with document alignment.

The apparatus 10 may be constructed to perform any number of known document processing actions as appreciated by one of ordinary skill in the art. Suitable electronics and mechanical mechanisms are located within base unit 12. For example, apparatus 10 may perform front and rear image capture, magnetic ink character recognition (MICR) reading, optical character recognition (OCR) reading, endorsing, and/or bar code reading depending on the application. Advantageously, the electronics and mechanical mechanisms required for the document processing actions are provided within base unit 12 as readily understood by one of ordinary skill in the art. The apparatus may be provided with a suitable network connection interface such as Ethernet or Universal Serial Bus (USB).

Input hopper 14 is an automatic, hands-off device that will feed a batch of checks into the base unit 12. Input hopper 14 receives and holds a batch of checks between side wall portion 20 and spring-loaded flag 22 which presses up against the last document in the loaded batch to keep the checks together. It is appreciated that apparatus 10 is suitable for processing checks as well as other financial and payment-related documents.

Divider element 24 includes a pocket selector 26 that allows checks to be sorted into, as shown, two pockets based on criteria such as high value amounts, image quality, reader rejects, and others. The pockets include first and second pockets 30 and 32, respectively. First pocket 30 is bound by side wall 34 of input hopper 14, and divider element 24. Second pocket 32 is bound by divider element 24 and wall 36.

Figure 2:
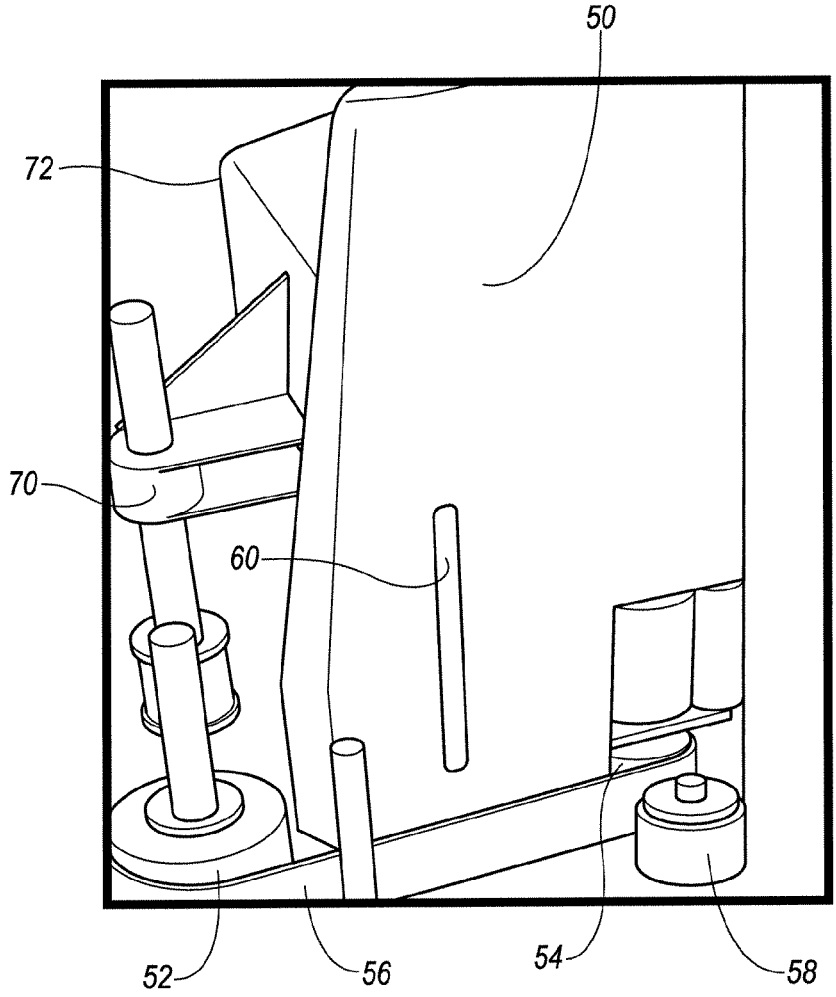
FIG. 2 illustrates a part of a document processor track wall and the location where the manual cleaning and capping station would be located.

FIG. 2 illustrates a part of a document processor track wall and the location where the manual cleaning and capping station would be located. In more detail, as known to those skilled in the art, a document processor includes a document track through which documents are conveyed, one at a time, for processing, and suitable mechanisms for transporting the documents through the track. In FIG. 2, the document processor track wall is indicated at 50, and pulleys 52 and 54, belt 56, and pinch roller 58 are transporting mechanisms. As also known to those skilled in the art, an opening 60 in the wall 50 allows the ink cartridge/endorser mechanism to access and print to the passing documents. Further illustrated in FIG. 2, carrier 70 contains the ink cartridge 72, and carrier 70 may be adjusted to one or more heights.

As documents pass in front of the ink jet cartridge (endorser) 72, information is imprinted on the document. As the ink jet cartridge 72 is used, spurious ink drops collect on the face of the cartridge 72 and must be removed to maintain good print quality. In accordance with the invention, wall portion 50 is modified to contain a manual cleaning and capping station, thereby building ink jet cartridge cleaning capability into the track wall directly in front of the cartridge 72.

Figure 3:
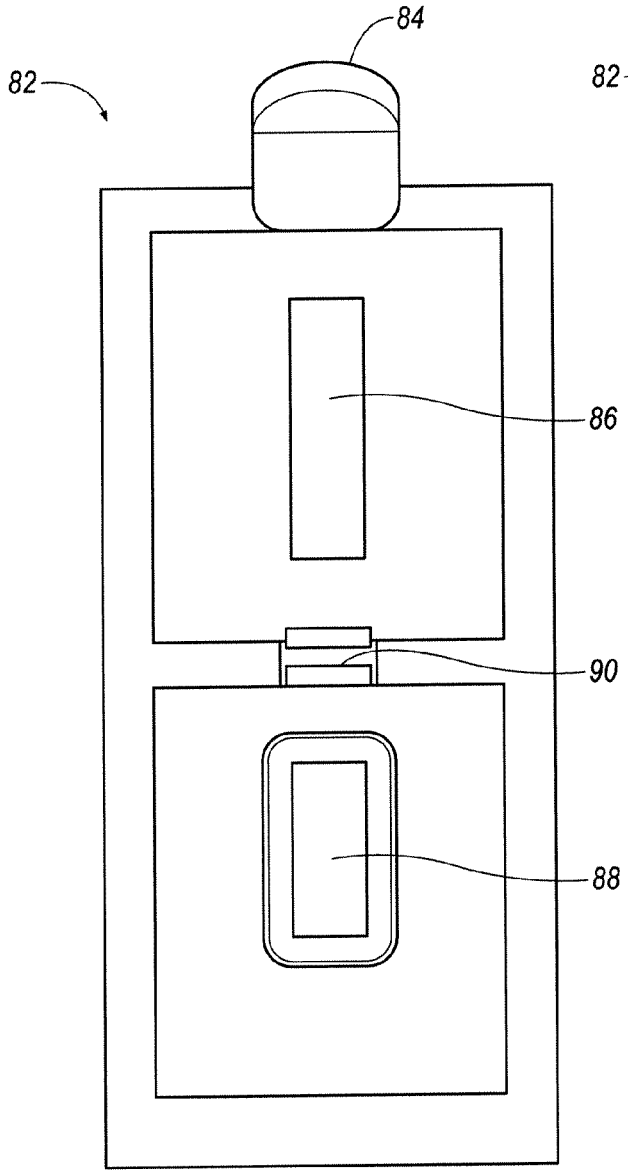
FIG. 3 illustrates a front view of a part of the track wall that slides up and down, providing cleaning and capping features in one embodiment of the invention.
Figure 4:
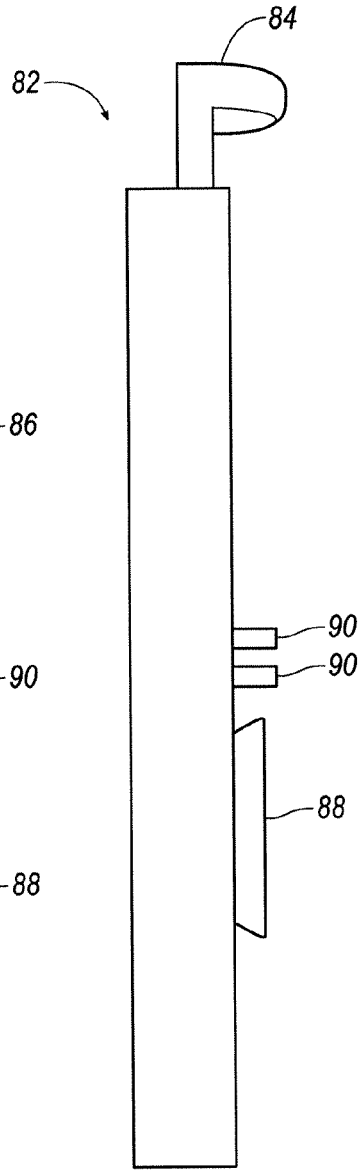
FIG. 4 illustrates a side view of the part of the track wall that slides up and down, providing cleaning and capping features in one embodiment of the invention.

FIG. 3 illustrates a front view of a part 82 of the track wall that slides up and down, providing cleaning and capping features in one embodiment of the invention. FIG. 4 illustrates a side view of the part 82 of the track wall that slides up and down. As shown, track wall portion 82 includes a tab 84 for assisting the operator in manually sliding the track wall portion 82 up and down. Further, track wall portion 82 includes an opening 86 for allowing ink to spray onto passing documents when opening 86 is aligned with the print nozzle on the ink jet cartridge, and includes a capping station 88 for covering the print nozzle on the inkjet cartridge when capping station 88 is aligned with the print nozzle on the ink jet cartridge. In addition, cleaning station 90 is located to slide across the ink jet nozzle as the track wall part 82 is slid up and down.

Figure 5:
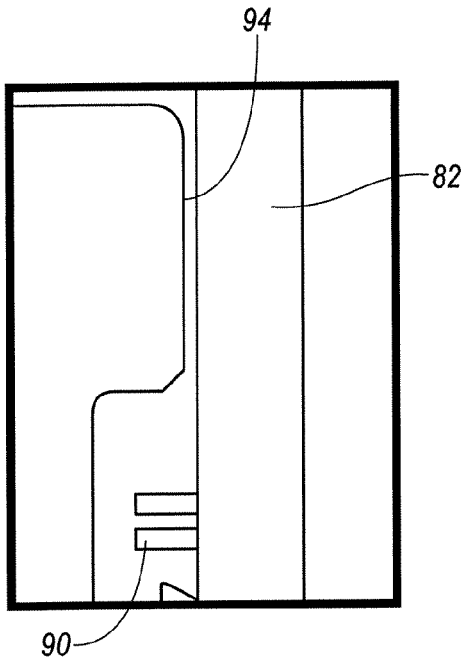
FIG. 5 illustrates a manual cleaning and capping station in the print position.

FIG. 5 illustrates the manual cleaning and capping station composed of track wall portion 82, in the print position. In the print position, the opening in the wall 82 aligns with the ink jet cartridge ink jet nozzle orifice plate 94.

Figure 6:
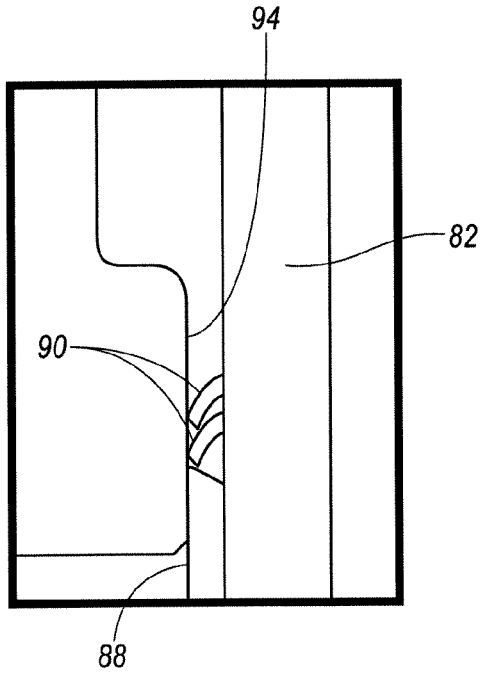
FIG. 6 illustrates the manual cleaning and capping station being moved up to clean the ink cartridge ink jet orifice plate.

FIG. 6 illustrates the manual cleaning and capping station being moved up to clean the ink cartridge ink jet orifice plate 94. The cleaning station is composed of a squeegee 90 that provides cleaning action when the station is being moved up or down.

Figure 7:
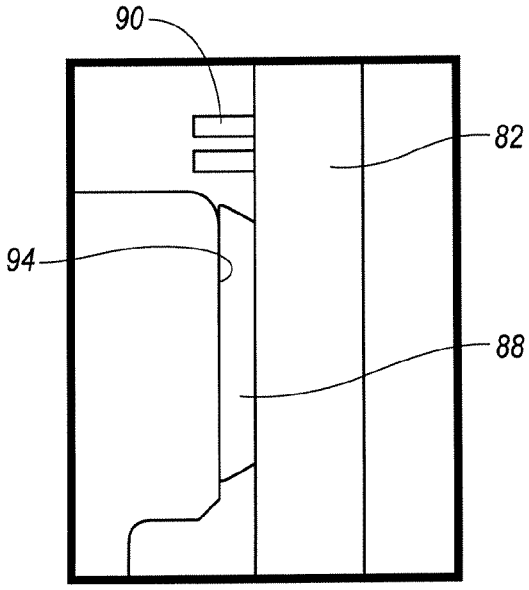
FIG. 7 illustrates the manual cleaning and capping station in the capped position.

FIG. 7 illustrates the manual cleaning and capping station in the capped position. In the capped position, the cap 88 covers the ink jet cartridge ink jet nozzle orifice plate 94, helping keep the ink from drying out as dried ink becomes difficult to clean off of the cartridge.

In the illustrated embodiment, the capped position is the fully up position for the track wall part 82. And, the opened or print position is the fully down position. Moving between fully open and fully closed cleans the face of the cartridge with the squeegee device 90.

It is appreciated that, in some embodiments, no covers have to be removed and the cartridge can remain within the carrier while it is being cleaned. The operator simply grabs the exposed tab to move the cleaning station up and down. The operator does not come in contact with spent ink. A whole cleaning cycle takes a few seconds, rather than minutes.

Figure 8:
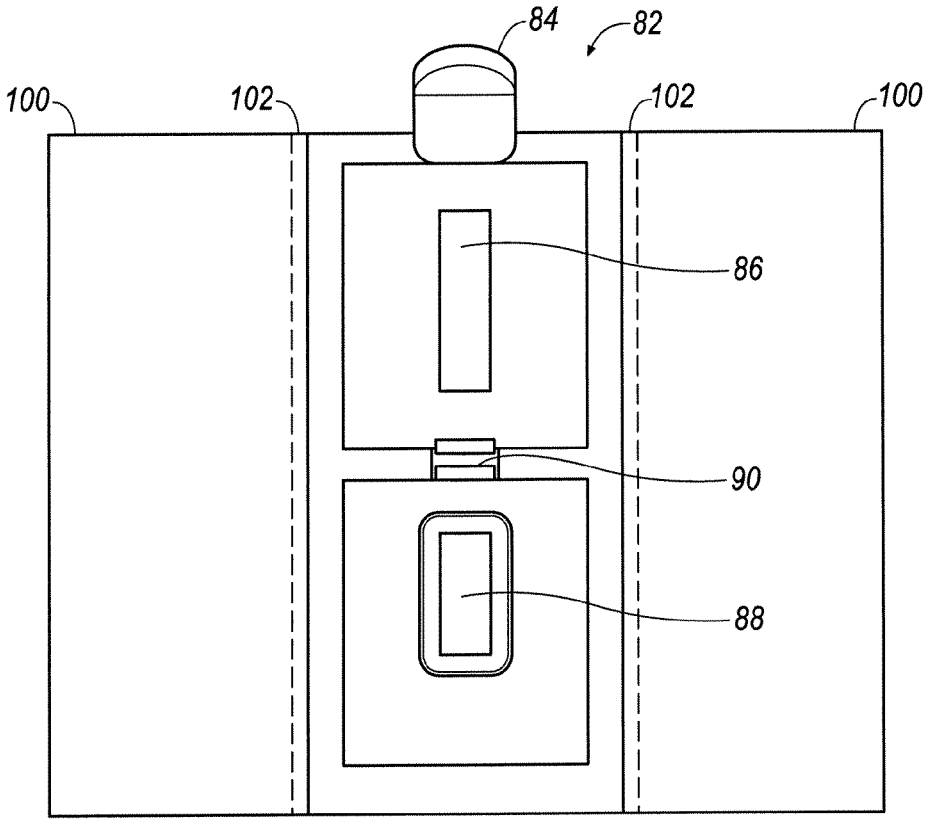
FIG. 8 illustrates the manual cleaning and capping station positioned within a section of track wall.

FIG. 8 illustrates the manual cleaning and capping station positioned within a section of track wall. In one embodiment, the manual cleaning and capping station 82 rides up and down within a section of track wall 100 via rails, grooves or other similar features 102. The feature on which the cleaning and capping station rides can be designed to provide a camming effect so that the capping station pivots onto, rather than slides across the ink jet nozzle orifice plate.

Figure 9:
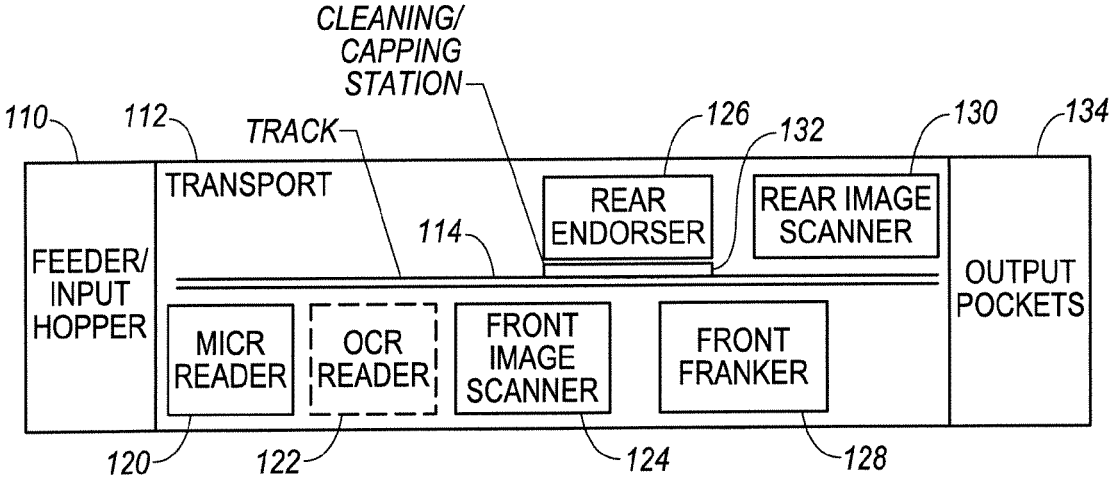
FIG. 9 is a schematic diagram illustrating a document processor in an embodiment of the invention.

FIG. 9 is a schematic diagram illustrating a document processor in an embodiment of the invention. It is appreciated that the diagram may represent a compact, desktop document processor, or may represent other document processors from low to medium and high-speed. As shown, a document processor for capturing data and images from checks and other financial and payment-related documents includes a feeder stage or input hopper 110, a transport stage 112 downstream of the feeder stage 110, and a document track 114. A plurality of processing devices are located along the document track 114.

In more detail, the illustrated document processor includes a magnetic ink character recognition (MICR) reader 120, an optical character recognition (OCR) reader 122, a front image scanner 124, a rear endorser 126, and a front franker 128. A rear image scanner 130 located along the document track 114 at a location downstream of the rear endorser 126. A manual ink jet cleaning and capping station 132 is built into the track wall 114 directly in front of the rear endorser 126. The station 132 includes a movable track wall portion that is movable between first and second positions and that includes an opening and a cap as exemplified in FIG. 8. Output pocket 134 receives the processed documents.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An apparatus for capturing data and images from checks and other financial and payment-related documents, the apparatus comprising:

a compact, desktop document processor base unit including an input slot for receiving a check to be processed, and including an output slot; and a transport stage located within the base unit, the transport stage including a document track and a plurality of processing devices located along the document track, wherein the plurality of processing devices includes an ink jet rear endorser, and a manual ink jet cleaning and capping station built into the track wall directly in front of the ink jet rear endorser, the station including a movable track wall portion that is movable between first and second positions and that includes an opening and a cap, wherein when the track wall portion is in the first position the cap engages the endorser to prevent any liquid ink on the endorser from drying, and wherein when the track wall portion is in the second position the opening aligns with the endorser to allow the endorser to print on passing documents, and further wherein the ink jet rear endorser substantially retains its position within the base unit whether the movable track wall portion is in a first position, in a second position or therebetween.

2. The apparatus of claim 1 further comprising:

a squeegee device located on the track wall portion between the opening and the cap such that the squeegee device wipes the endorser as the track wall portion is moved between the first and second positions.

3. The apparatus of claim 1 wherein the plurality of processing devices further includes a rear image scanner located along the document track at a location downstream of the rear endorser.

4. The apparatus of claim 1 further comprising:

a carrier mounted to the base unit and receiving the endorser, the carrier being adjustable to provide a plurality of selectable heights for the endorser with respect to the track wall.

5. The apparatus of claim 1 wherein the track wall portion slides in a vertical direction between the first and second positions, and wherein documents being routed through the document track travel in a horizontal direction.

6. The apparatus of claim 1 wherein the station includes an exposed tab connected to the track wall portion for use by a user to move the track wall portion.

7. The apparatus of claim 1 wherein the plurality of processing devices further includes a front image scanner located along the document track.

8. The apparatus of claim 1 wherein the plurality of processing devices further includes a magnetic ink character recognition (MICR) reader located along the document track.

9. The apparatus of claim 1 wherein the plurality of processing devices further includes an optical character recognition (OCR) reader located along the document track.

10. An apparatus for capturing data and images from checks and other financial and payment-related documents, the apparatus comprising:

a document processor including a document track and a plurality of processing devices located along the document track;

wherein the plurality of processing devices includes an ink jet rear endorser; and a manual ink jet cleaning and capping station built into the track wall directly in front of the ink jet rear endorser, the station including a movable track wall portion that is movable between first and second positions and that includes an opening and a cap, wherein when the track wall portion is in the first position the cap engages the endorser to prevent any liquid ink on the endorser from drying, and wherein when the track wall portion is in the second position the opening aligns with the endorser to allow the endorser to print on passing documents, and further wherein the ink jet rear endorser substantially retains its position within the base unit when the movable track wall portion is in a first position and in a second position.

11. The apparatus of claim 10 further comprising:

a squeegee device located on the track wall portion between the opening and the cap such that the squeegee device wipes the endorser as the track wall portion is moved between the first and second positions.

12. The apparatus of claim 10 wherein the plurality of processing devices further includes a rear image scanner located along the document track at a location downstream of the rear endorser.

13. The apparatus of claim 10 further comprising:

a carrier receiving the endorser, the carrier being adjustable to provide a plurality of selectable heights for the endorser with respect to the track wall.

14. The apparatus of claim 10 wherein the track wall portion slides in a vertical direction between the first and second positions, and wherein documents being routed through the document track travel in a horizontal direction.

15. The apparatus of claim 10 wherein the station includes an exposed tab connected to the track wall portion for use by a user to move the track wall portion.

16. The apparatus of claim 10 wherein the plurality of processing devices further includes a front image scanner located along the document track.

17. The apparatus of claim 10 wherein the plurality of processing devices further includes a magnetic ink character recognition (MICR) reader located along the document track.

18. The apparatus of claim 10 wherein the plurality of processing devices further includes an optical character recognition (OCR) reader located along the document track.

* * * * *